United States Patent [19]

Kemeny et al.

[11] 4,329,971

[45] May 18, 1982

[54] ELECTROMAGNETIC PROPULSION POWER SYSTEM

[75] Inventors: George A. Kemeny, Wilkin Township, Allegheny County; Joseph G. Gorman, Murrysville, both of Pa.

[73] Assignee: Westinghouse Electric Corp., Pittsburgh, Pa.

[21] Appl. No.: 111,628

[22] Filed: Jan. 14, 1980

[51] Int. Cl.[3] ..... F41F 1/02

[52] U.S. Cl. ..... 124/3; 89/8

[58] Field of Search ..... 89/8; 124/3; 310/12

[56] References Cited

U.S. PATENT DOCUMENTS 2,783,684 3/1957 Yoler ..... 124/3

FOREIGN PATENT DOCUMENTS 1903959 8/1970 Fed. Rep. of Germany ..... 89/8

560896 4/1944 United Kingdom ..... 89/8

OTHER PUBLICATIONS

J. Appl. Phys. 49(4) (4/78) Rashleigh et al.

Acceleration of Macroparticles and Hypervelocity Electromagnetic Accelerators, 3/72, Barber.

*Primary Examiner*—Sal Cangialosi

*Attorney, Agent, or Firm*—F. J. Baehr, Jr.

[57] ABSTRACT

An electromagnetic propulsion power supply system utilizing mutual induction coils as transformers to provide high currents to the projectile rail conductors.

15 Claims, 4 Drawing Figures

ELECTROMAGNETIC PROPULSION POWER SYSTEM

This invention relates to electromagnetic propulsion and more particularly to a power system for such propulsion.

Electromagnetic propulsion involves the vectorial multiplication of current density times flux density to produce a force, which accelerates a projectile. The configuration of elements is conceptionally simple, parallel rails are energized with high DC current to provide a high density magnetic field, which produces a large generally constant acceleration force on the current conducting armature which pushes the projectile. During the brief period of projectile acceleration, the power supplied to the projectile rail system is likely to be in the range of gigawatts and such power levels can only be economically attained utilizing pulse compression configurations. Samples of which will be described hereinafter.

SUMMARY OF THE INVENTION

A circuit for supplying DC power to a pair of conductors utilized in an electromagnetic projectile launcher, when made in accordance with this invention, comprises a source capable of producing high DC current, an induction coil for temporarily storing electromagnetic energy, and switching means for opening and closing the circuit. The current source, inductance coil and switching means are electrically connected in series and cooperate with turns associated with the induction coil to temporarily produce higher currents then those produced by the circuit including the current source. Low resistant leads electrically connect the turns to the pair of conductors.

BRIEF DESCRIPTION OF THE DRAWINGS

The object advantages of this invention will become more apparent from reading the following detailed description in connection with the accompanying drawings, in which.

DESCRIPTION OF THE PREFERRED EMBODIMENTS

Figure 1:
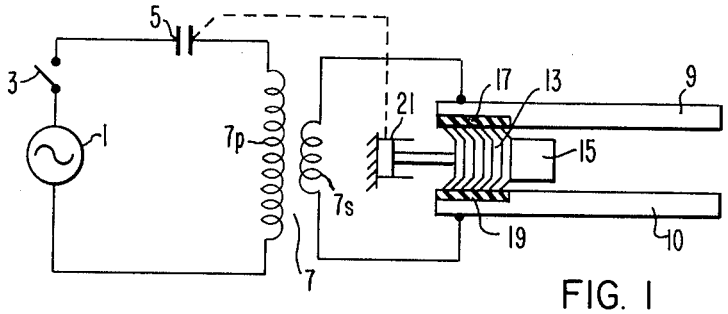
FIG. 1 is a schematic diagram of an electromagnetic power supply made in accordance with this invention.

Referring now to the drawings in detail and in particular to FIG. 1 there is shown an electromagnetic propulsion power supply circuit, comprising a DC power source such as a homopolar generator, a DC generator, or an AC generator with appropriate rectifying means or any other power source 1 capable of producing a high DC current; means for closing a circuit 3 and means for breaking a circuit 5 such means may be separate devices as shown or a single device may be utilized to perform both functions; a multi-winding induction coil 7 having a primary coil $7_P$ and a secondary coil $7_S$. The power source 1, means for making the circuit 3, means for breaking the circuit 5, and primary coil $7_P$ of the induction coils 7 are electrically connected in series. The primary coil $7_P$ and secondary coil $7_S$ may be disposed one inside of the other and generally the primary coils $7_P$ has substantially more turns than the secondary coil $7_S$.

A pair of conductive rails or conductors 9 and 10 are respectively connected electrically to opposite ends of the secondary coil $7_S$ and a conductive armature 13 slideably engages the conductors 9 and 10. A projectile 15 is disposed on the leading end of the armature 13. Insulating strips 17 and 19 are disposed, respectively, on the leading end of the rails 9 and 10 insulating the armature 15 from the rails 9 and 10. While two insulating strips are shown one insulating strip would suffice to prevent a premature circuit from being formed between the secondary coils $7_S$, the armature 13 and the rails 9 and 10. Means for moving the armature 21 beyond the insulating strips 17 and 19 is disposed adjacent the trailing end of the conductors 9 and 10 and may be actuated by the same device which opens the circuit breaking means 5 so as to synchronize the opening of the circuit including the primary coil $7_P$ and completing the series circuit including the secondary coil $7_S$ and the conductors 9 and 10 and the armature 13. It being understood that the circuit including the secondary coil and armature 13 may be closed a short time before the circuit breaker 5 interrupts the current flowing to the coil to the primary coil $7_P$.

The operation of the circuit is as follows. Energy from a prime mover (not shown) is transferred to a generator such as a homopolar generator 1 bringing it up to a predetermind speed, the make switch 3 is closed, current flow is initiated and electromagnetic energy is temporarily stored in the primary induction coil $7_P$ When a predetermined magnitude of current flows in the circuit, the breaker switch 5 is opened substantially instantaneously transferring the electromagnetic energy stored in the primary coil $7_P$ to the secondary coil $7_S$. The armature 13 is advanced by neumatic, hydraulic, electromagnetic, explosive, or a spring acutated device 21, which moves the armature from the insulating strips 17 and 19 closing the circuit which includes the secondary coil $7_S$ commutating a large amount of current into the conductors 9 and 10 and armature 13. The initiation of current flow into the conductors 9 and 10 and armature 13 happens very rapidly and current flow then continues for a duration which depends on the projectile acceleration requirements and this duration may be in the neighborhood of milliseconds. Calculations have shown that enormous currents are required to attain high velocities. For example, for the configuration illustrated to obtain a velocity of 10,000 feet per second for a mass of about $\frac{3}{4}$ of a pound, utilizing a launch rail length of approximately 14 feet, requires a current in the circuit including the secondary coil $7_S$ of about 1.5 million amps. Assuming a 3:1 turn ratio between the primary coils $7_P$ and the secondary coils $7_S$, the current in the circuit including the primary coil $7_P$ would be in the neighborhood of 500,000 amps.

Figure 2:
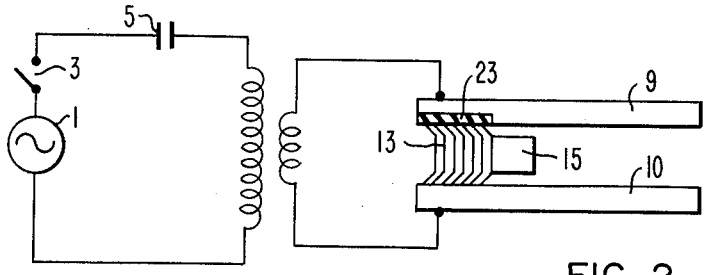
FIG. 2 is a schematic diagram of an alternative embodiment.

FIG. 2 shows a power supply system similar to that shown in FIG. 1 except there is only a single insulating strip 23 disposed between the conductor 9 and the armature 13. The insulating strip 23 has the property of breaking down as the voltage across the insulating strip 23 increases to a predetermined level as the circuit breaker 5 opens. Thus, causing the current to flow through the rails 9 and 10 and armature 13 to accelerate the armature 13 and projectile 15.

Figure 3:
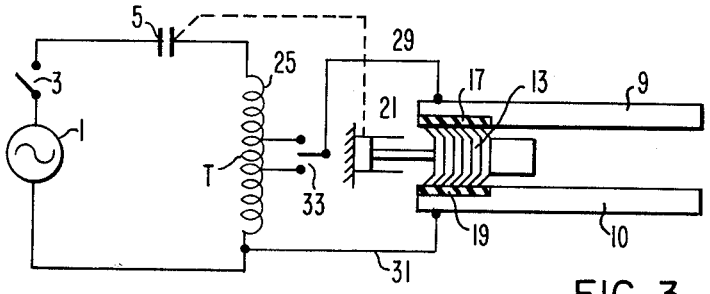
FIG. 3 is a schematic diagram of another alternative embodiment.

FIG. 3 shows a power supply system, which is similar to that shown in FIG. 1, except that instead of the flux linked primary and secondary coils $7_P$ and $7_S$, a single induction coil 25 is utilized. The single induction coil 25 has a number of turns T connected in series with the conductors 9 and 10 by leads 29 and 31, respectively. During projectile acceleration the turns T carry a high current and may have a larger cross section than the remainder of the coil. Tapping means 33 may also be provided to vary the number of turns T connected to the rails 9 and 10 yielding a variable range of propulsion currents.

Figure 4:
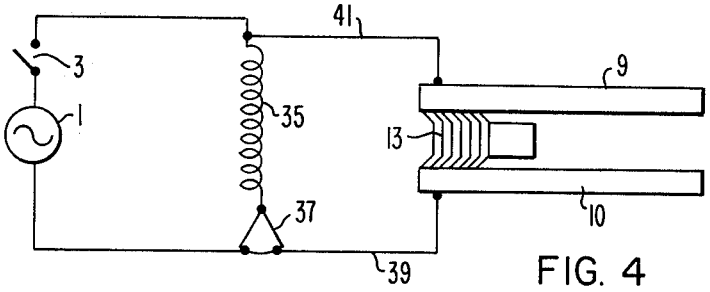
FIG. 4 is a schematic diagram of another electromagnetic supply system.

FIG. 4 shows a power supply system in which the DC power source 1 and make switch 3 are connected in series with an induction coil 35. A diverter switch 37 is connected only to the source 1, when in one position, and also connects the rail or conductor 10, when in another position utilizing the lead 39 and finally disconnects the source 1 while maintaining electrical connection with the rail 10, when in a third position. A lead 41 electrically connects the end of the coil 35 opposite the diverter switch 37 to the conductive rail or conductor 9 so that when the diverter switch 37 is switched from the source to the rail 10 a circuit is formed including the coil 35 the rail 9 the armature 13 and rail 10, thus electromagnetically accelerating the armature 13 and projectile 15 along the rail.

It should be observed that for the FIGS. 1 and 2 double coil configurations, the primary and secondary induction coils should be wound or geometrically arranged in such a manner that substantially all the magnetic flux, which is the intermediate energy storage means, links both coils as this will give efficient and rapid energy or current transfer from the primary to the secondary coil. On the other hand, if the coils are poorly designed, the primary may have a substantial leakage flux which does not link the secondary turns and in this case, when the breaker 5 is opened, energy stored in the primary coil leakage flux will be mostly dissipated in arcing at the breaker, thus resulting in more severe breaker duty and, of course, unavailability of this energy for propulsion. For the FIG. 3 configuration, all turns of coil 25 should substantially link the flux through the coil.

The power supply systems hereinbefore described advantageously allow the rotating machine to be designed for lower current levels and higher voltage levels. Lower currents for the DC generator means less brushes, which result in smaller more efficient and less expensive machinery. Designing for higher voltages involves known and already practiced procedures. With the primary current levels reduced it is practical and efficient to have longer transmission distances between the rotating energy storage and the propulsion system consisting of the storage coils and rail system. For military applications this would allow a single kinetic energy storage system to supply a number of separately located launching systems which may fire at the same time, but which may have various launching current ratings. By reducing the primary current level, the required circuit breakers for opening the primary circuit better matches existing or soon to be developed commercial equipment. Presently there is no commercial equipment for diverting or switching 1½ million amps of DC current. If, however, the primary current is reduced to about 30,000 amps at up to possibly about 50 kvdc, the switching operation may then be handle by a single vacuum breaker interrupter now commercially available. Solid state switching in the primary circuit is another possibility made more attractive by reducing the current levels in the circuit.

What is claimed is:

1. A circuit for supplying DC power to a pair of parallel conductors utilized in an electromagnetic projectile launcher, said circuit comprising means for providing high DC current;

an induction coil for temporary storing electromagnetic energy;

means for opening said circuit when the current flowing through said induction coil is high;

said current providing means, induction coil, and means for opening said circuit being electrically connected in a series loop;

turns cooperatively associated with said induction coil; and leads electrically connecting said turns to said pair of parallel conductors;

said circuit being so arranged that said circuit opening means is opened to initiate launching said projectile and energy stored in said induction coil is rapidly converted in said turns to a higher current than that provided by said current providing means, said higher current being supplied via said leads to said pair of parallel conductors substantially continuously during the launch of said projectile.

2. A circuit as set forth in claim 1 and further comprising an insulating strip disposed on at least one of said conductors adjacent one end thereof and an armature slideably disposed between said conductors.

3. A circuit as set forth in claim 2, wherein said insulating strip breaks down at a predetermined voltage.

4. A circuit as set forth in claim 2 and further comprising means for initiating movement of said armature from said insulating strip.

5. A circuit as set forth in claim 1, wherein said turns are on a secondary coil which cooperates with said first mentioned coil by linking substantially the same magnetic flux.

6. A circuit as set forth in claim 1, wherein said turns are a predetermined number of turns of said induction coil.

7. A circuit as set forth in claim 2, wherein said turns form a secondary coil which cooperate with said first mentioned coil by linking the same magnetic flux.

8. A circuit as set forth in claim 2, wherein said turns are a predetermined number of turns of said induction coil.

9. A circuit as set forth in claim 4 and further comprising means for initially moving said armature from said insulating strip.

10. A circuit as set forth in claim 4, wherein said turns are a predetermined number of turns of said induction coil.

11. A circuit as set forth in claim 3, wherein said turns form a secondary coil which cooperates with said first mention coil by linking substantially the same magnetic flux.

12. A circuit as set forth in claim 3, wherein said turns are a predetermined number of turns of said induction coil.

13. A circuit for supplying DC power to a pair of parallel conductors utilized in an electromagnetic projectile launcher, said circuit comprising means for providing high DC current;

an induction coil for temporarily storing electromagnetic energy;

means for closing the circuit;

said current providing means, said circuit closing means and said induction coil being connected in a series loop; and a diverter switch for switching current from the series circuit containing said induction coil said circuit closing means and said current providing means to a circuit containing said induction coil, and said parallel conductors.

14. A circuit as set forth in claim 13 and further comprising an armature slideably engaging said pair of conductors.

15. A circuit as set forth in claim 14 wherein the diverter switch closes the circut including the pair of conductors prior to opening the circuit including the current providing means.

* * * * *